US006158791A

United States Patent [19]

Drew

[11] Patent Number: 6,158,791

[45] Date of Patent: Dec. 12, 2000

[54] SNOW REMOVAL DEVICE FOR ROOFS, FLAT SURFACES AND THE LIKE

[76] Inventor: Stephen C. Drew, P.O. Box 1951, Homer, Ak. 99603

[21] Appl. No.: 09/479,272

[22] Filed: Jan. 4, 2000

[51] Int. Cl.[7] ..... E01H 5/02

[52] U.S. Cl. ..... 294/54.5; 37/285

[58] Field of Search ..... 294/49, 51, 54.5, 294/56, 57, 59; 37/241, 265, 266, 284, 285, 268; 15/106, 111

[56] References Cited

U.S. PATENT DOCUMENTS

| | | | |
|---|---|---|---|
| 2,867,827 | 1/1959 | Gantz | 294/54.5 |
| 2,950,547 | 8/1960 | Murphy | 37/285 |
| 3,218,738 | 11/1965 | Bowerman | 294/54.5 |
| 3,483,643 | 12/1969 | Wenzel | 294/54.5 |
| 3,998,486 | 12/1976 | Mittelstadt . | |
| 4,024,654 | 5/1977 | Snyder . | |
| 4,070,771 | 1/1978 | Yakiwchuk . | |
| 4,185,403 | 1/1980 | Hardgrove . | |
| 4,249,767 | 2/1981 | Andreason . | |
| 4,253,257 | 3/1981 | Albert . | |
| 4,386,474 | 6/1983 | Mechauich et al. . | |
| 4,550,943 | 11/1985 | Mirto . | |
| 4,669,206 | 6/1987 | Yost . | |
| 4,848,819 | 7/1989 | Moorefield . | |
| 5,083,388 | 1/1992 | Cooley . | |
| 5,465,510 | 11/1995 | Goodnough et al. . | |
| 5,524,369 | 6/1996 | Phillips . | |
| 5,570,524 | 11/1996 | Groat . | |
| 5,676,413 | 10/1997 | Hauck | 294/54.5 |
| 5,727,829 | 3/1998 | Bellichak | 294/54.5 |
| 5,943,796 | 8/1999 | Hedstrom . | |

*Primary Examiner*—Dean J. Kramer
*Attorney, Agent, or Firm*—Michael J. Tavella

[57] ABSTRACT

A snow removal system that has a primary cutter assembly and a series of specialized attachments. The cutter assembly is formed from a length of aluminum bent to form a single horizontal cutting bar with two vertical cutting wings. The cutter bar has a tailpiece formed from a length of stiff but flexible plastic attached to the back edge. An elevated center bar serves as the thrust point and fixture for several of the attachments. The attachments to the cutter assembly include: a toggling plate; extensions to the vertical side bars that can be forward, vertical or trailing; a starting aid and depth setter; an edge limiting aid; a broom, set to the proper angle for a given application; an extension to the plastic tailpiece; and a bottom protector plate. Thrust or pull for the cutter assembly is achieved by the use of several special push-pull tubes. A simple elastic cord is used to secure the plastic tailpiece to the cutter assembly for storage.

19 Claims, 14 Drawing Sheets

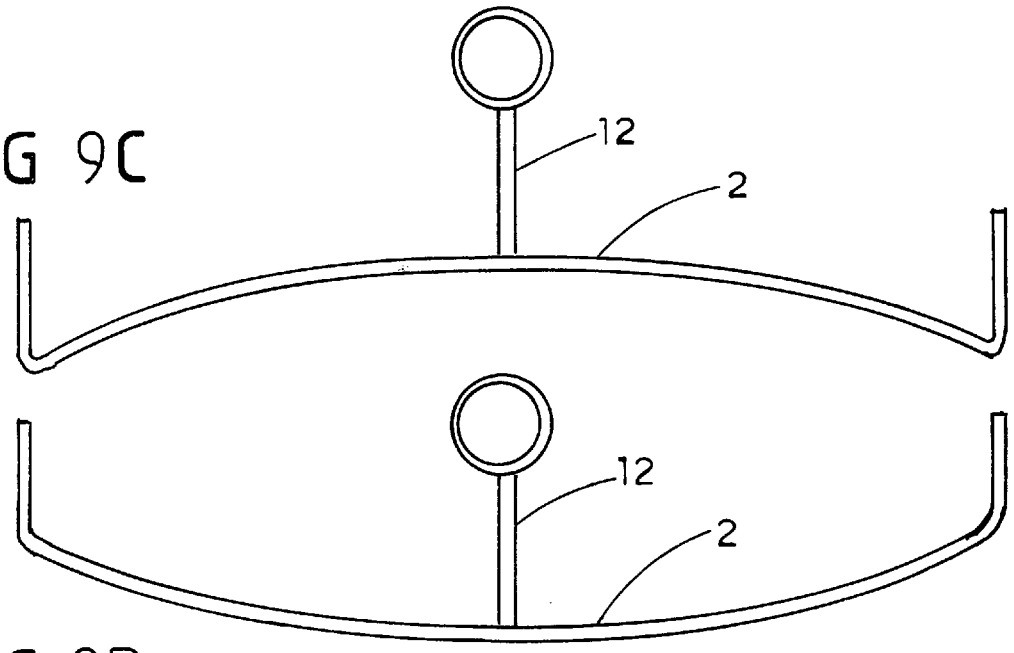
FIG 9C
FIG 9D
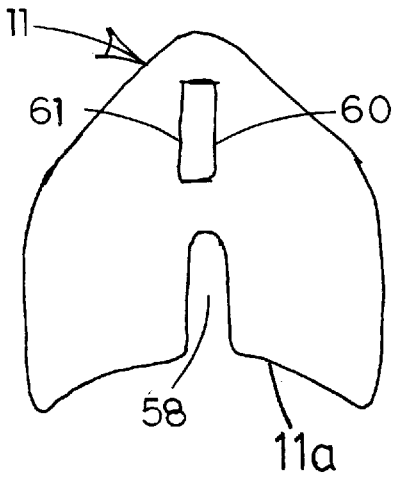
FIG 9E
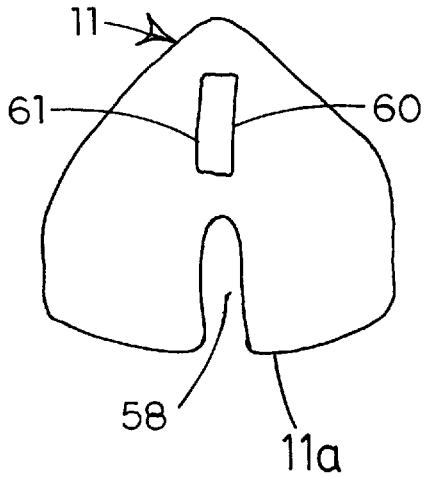
FIG 9F

SNOW REMOVAL DEVICE FOR ROOFS, FLAT SURFACES AND THE LIKE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to snow removal devices and particularly to snow removal devices for relatively flat surfaces and the like.

2. Description of Related Art

Snow is an extremely variable material. It can easily range from a light fluffy material that cannot support any significant loading to wind driven and frozen material that can be sawed into blocks and used as structural building material. Its hardest form is pure ice, formed by repeated freeze thaw cycles.

In climates susceptible to winter snow falls, the loading of structures caused by the weight of the accumulated material is of major concern. Other significant factors include the ice dam effects common to roof eaves, the risk to personnel movement caused by the concealment of dangerous objects or surfaces and the risk of injury from heavy snow masses falling from above.

To alleviate these snow-related problems, snow removal devices have been created. The current art of specialized snow removal devices has primarily focused on pitched dwelling roofs. Flat roofs have been handled using tools equally suited to ground level operations, such as scoop shovels and the like.

The most common method to date for dealing with snow accumulations on pitched roofs is still for a person to climb up to, and walk on, the surface. A scoop or push shovel is then used to mechanically move the material to the edge, and let gravity pull it to the ground. Several devices have been proposed which use a cutting method followed by a friction-reducing device, such as a plastic chute, to allow the snow to slide to the eave by the force of gravity. Several of these methods use a push rod to allow the operator to remain on the ground and move the cutter through the snow mass. Others require the operator to be on the roof surface and move the cutter through the snow. Two fundamental concepts that all of these methods have in common are: (1) the assumption that the surface has a sufficient pitch that once the snow is cut and placed on the friction reducing method, it slides on its own and, (2) the snow is soft enough that the cutting edge moves easily through the snow mass.

Snow removal from flat or shallow pitch surfaces is a difficult and often dangerous task. The most common approach is to place a person on the structure and use conventional snow shovels, push scoops, or brooms to carry the material to the edge, where it is allowed to naturally fall away. This approach is fraught with potential danger to the operator and damage to the property. Deep, compacted snow coupled with fragile surfaces such as greenhouse roofs or aircraft wings can compound the problems to an almost impossible level. It should also be recognized that in many cases it is not required to remove all of the snow from the entire surface area of a given structure. If the most serious problem is removing a hazard, this may mean clearing only a local area above a door or sidewalk. To reduce the load on a roof, for example, it is only necessary to remove a part of the snowpack. Almost any surface can support a 6-inch deep layer of snow. Ice dams caused by poor venting from the eave to the attic space can often be significantly reduced by removing the snow to a depth of 1 or 2 inches a distance 3 or 4 feet from the eave.

I have divided roofs and other surfaces into two different classes for the purpose of snow removal: fragile and hazardous. Class 1 surfaces are considered fragile. The classic fragile surface is a greenhouse roof, tent, aircraft wing, or boat cover. Typical construction for green houses is a frame supporting glass or plastic panels. The panels are often capable of supporting large, well-distributed static loads. The failure mode for these structures is often not the initial breakage of the glass, but collapse of the support system. The glass cannot support high point loads however and walking or chopping at accumulated snow with hoe-type tools may break the glass. Tents, yurts, canvas boat covers, and a wide range of temporary structures covered with plastic film or tarps can also be considered in the class 1 group. These surfaces usually do not support a person under any circumstances and sag as snow accumulates. The tops of truck cabs, buses, recreational vehicles and motor homes also accumulate snow but do not support point loads well. Walking on these surfaces in cold temperatures often breaks the water proofing seals resulting in water leakage.

Aircraft wings are another class 1 surface. Most current configurations set the wings at or near a horizontal plane. Even with the general pitch from front to back, the surface does not shed snow on its own. Many older aircraft have wings covered with a cotton type fabric that is very susceptible to point loads. Certain areas of the wings are especially susceptible to damage due to snow loading. These areas are the flaps, ailerons, and the elevators of horizontal stabilizers. These are all hinged surfaces and cable tensions increase with high cantilever loading. Removal of snow accumulation in small controlled lifts reduces the chance of damage due to sudden shifts of weight, which can happen with uncontrolled movement of large blocks of snow.

Class 2 surfaces are hazardous to personnel engaged in snow removal. A large flatbed trailer with a load of pipe and rebar is typical of this class. Once the snow has covered the material, footing is difficult and the slick surfaces coupled with unknown sharp objects or gaps, make it very dangerous to walk on the trailer and remove the snow with a shovel. Metal roofs of almost any pitch are hazardous surfaces. Modern paints are very slick and even surfaces with modest pitches make it difficult to maintain footing. Shake roofs are hazardous for opposite reasons. Snow may adhere to the shakes such that, even with steep pitches, significant buildup can occur. Cornices develop at the eave and can overhang several feet. Danger to personnel, both from the static loading of the structure, and from falling snow and ice is significant.

In addition to the class 1 and 2 surfaces, another category of difficult snow removal situations exists. Confined or low headroom spaces often fill with wind blown snow. Snow may need to be removed from an area below the operator, requiring a lifting out action. Vehicles that are stuck or parked in open areas can easily fill with snow between the vehicle and the ground, with the snow packed under the vehicle being the most difficult to remove. Another example is avalanche victim rescue. If the operator cannot enter the space, a snow shovel is often very awkward and inefficient As discussed above, there are many conditions where rake or cutter type devices are not appropriate or effective. The chopping action required for removal of all but the softest snow results in damage to the surface whether the operator stands on the surface, or below it. Hoe and rake type devices have little ability to control the cutting depth or the amount of snow to be removed. Several methods have been proposed in an attempt to protect the surface and act as aids in moving over irregularities such as shingles. Examples of hoe type devices can be found in U.S. Pat. Nos. 4,848,819, 4,550,943, 5,465,510, 4,386,474, 4,249,767 and 4,024,654.

Many surfaces do not support a person, or have pitch angles, resulting in inability to use cutters requiring the operator to be in close proximity. Examples of this type of device are found in U.S. Pat. Nos. 5,570,524, 4,669,206, 4,070,771, 4,253,257 and 4,185,403.

The other devices using a push or pull type motivation method have several limitations. These limitations result from: a) the means used to control or facilitate the travel of the loosened snow towards an edge, b) the angle of delivery of thrust, c) the force necessary for effective use, and d) precision of control of the action.

Several devices have a slide or tailpiece to facilitate movement of snow. The use of very flexible type friction reducing materials often requires a complex method of rolling the material about the cutter area, resulting in moving parts and weak structure. Hinges and cranks are susceptible to ice accumulation and jamming due to frozen material.

Some devices have the thrust directed toward the center of the cutting bar, but do not provide sufficient structural strength to accommodate hard packed or very deep snow conditions. Sufficient length of the pole and distance of the operator from the path of descending snow blocks addresses only part of the hazard to operators. Attaching the thrust tube low on the cutter bar causes the push tube to ride below the surface of the snow block being removed. Devices with that configuration can cause the falling snow mass to exert large downward loads on the handle, and pose danger to the operator. Examples of these types are found in U.S. Pat. Nos. 5,943,796, 5,524,369, 5,083,388 and 3,998,486.

Special risks and problems exist when a significant depth of snow must be removed from a roof or like surface. Extensive avalanche research has shown that slab avalanches occur most often at slope angle between 30 and 45 degrees. This corresponds to roof slopes of 7/12 to 12/12. Modem metal roof paints often shed at slopes of 4/12. Chopping at snow accumulations on these slopes with rake or hoe devices can produce shock effects that allow the snow layer bonds to break and fall away in a classic slab avalanche. The chopping action also can produce a fissure that propagates across the snow mass, releasing an unpredictable amount of snow. Key to operator safety is the ability to start by removing layers from the top of the snow surface and working towards lesser depths, or matching the depth of the effective slice to the density and depth of the snow.

The ability to balance and position the implement for effective forward or reverse thrust is essential for the health and safety of the operator. Starting the first cut at a controlled depth and preventing the cutter bar from hanging up at the eave are two difficult areas. Although several devices have attempted to address the eave problem with extension from the side supports, no other device has addressed the ability to accurately control the depth of the snow removal cut.

BRIEF SUMMARY OF THE INVENTION

This invention addresses the problems discussed above without degrading the functionality of the basic cutter assembly. Increased control and effectiveness at the leading edge of the device reduces arm and shoulder stress, and reduces the overall effort required, resulting in a much safer system.

I have devised a system that addresses both class 1 and class 2 surfaces. This device is also well suited to confined spaces and limited vertical lifting. This snow removal system has a primary cutter assembly and a series of specialized attachments. The cutter assembly is formed from a length of aluminum flat stock bent to form a single horizontal cutting bar with two vertical cutting wings. The cutter bar has a tailpiece formed from a length of stiff, but flexible, plastic attached to the back edge. An elevated center bar serves as the thrust point and fixture for several of the attachments. The nature of the elevated and sharpened edge of the push tube attachment point breaks up the snow mass and allows the tube extensions to ride above the detached snow mass and remain clear as the snow slides away. The attachments to the cutter assembly include a duck bill starting aid and depth setter, an edge limiting aid, a toggling plate, a broom set to the proper angle for a given application, an extension to the plastic tailpiece, and a bottom protector plate. Extensions to the vertical side wings can be placed in a forward, vertical or trailing position. One of these same extensions can be attached to the center support in either a vertical or forward facing direction. Thrust or pull for the cutter assembly is achieved by the use of several special push/pull tubes. A simple elastic cord is used to secure the plastic tailpiece to the cutter assembly for storage.

The basic cutter assembly has no moving parts and the accessories are easily attached or removed by depressing simple spring pins, or the use of simple tools. There are only two replaceable components, and these can be serviced using common hand tools and basic skills.

The primary aspect of this invention is the ability to control the amount of snow to be moved. To achieve this, several fundamental differences exist between this device and others representing the current art. One of these fundamental differences is the use of a unique depth setter to control the depth of cut, providing improved safety and efficiency. Another of these differences is the use of a sufficiently stiff tailpiece to carry a load of snow across a flat surface. These differences, and others described, reduce the effort needed to remove the snow from the surface being cleaned.

The depth setter is in the form of a duckbill shaped paddle that projects above and in front of the main cutter bar. The duck bill paddle rests on the undisturbed snow mass prior to allowing the cutter bar to enter the snow. It thus automatically limits the depth of cut of each pass with the cutter.

The stiff tailpiece is another example of the fundamental difference between this device and others using highly flexible tarp type materials. The stiffness of the tailpiece is such that it does not collapse on itself as it is withdrawn with the load of snow and yet it flexes under the weight of the snow as it clears the eave to allow gravity to pull the snow to earth. Plastic material ranging in thickness from 30 mil to 80 mil has proven suitable for this purpose.

The elevated center support and its affixed tubular coupler allow for the thrust driver handle to extend beyond the front of the main cutter bar. Other accessories are then mounted in front of the main cutter bar, supported by their attached tubular couplers.

The eave stopper is an accessory that is attached in the manner described above. The eave stopper is a shoe, a support bar and a tubular coupler. The shoe is fabricated from a length of ultra high molecular weight stock in the shape of a knife blade. The shoe is attached to a bar extending upward a distance equal to the height of the main center support. The top of the bar is then attached to a tubular coupler by welding or other means. The thickness of the shoe allows it to cut through the snow in a downward direction like a blade. The cutter assembly is then withdrawn until the tip of the eave stopper shoe rests on the edge supporting the assembly clear of the snow, but level with the eave edge. This action allows the cutter bar to enter the snow mass at the eave very close to the surface.

To add reverse thrust to loose snow, a toggle plate is also attached to the center support. This toggle plate swings up as the cutter is moved forward and downward as the cutter bar is pulled back. The downward position acts as a retainer and holds loose snow in place and in position on the tailpiece.

Snow remaining on a surface is removed by attaching a broom set at the proper angle for efficient use. The broom attachment is secured to the vertical center bar in the same fashion as the other attachments.

The stiff tailpiece is highly effective in relatively short lengths, typically four feet. Special applications can be easily addressed by adding additional four or eight foot segments to reach any desired length.

The aluminum cutter bar is highly effective in its basic form but can cause scratching of painted surfaces or leave marks caused by the bare aluminum. A bottom protector is an attachment fabricated from plastic material that is secured to the bottom surface of the cutter bar by rivets or other means. The plastic is ribbed to break up the snow layer closest to the surface and beveled on the front and rear edges to allow it to glide over small obstructions.

The cutter assembly is of sufficient strength to allow for a chopping action required to remove consolidated or frozen snow. All forward facing edges are sharpened to a 15 degree bevel by machine cutting.

The blade is of sufficient front to back width to allow for the lifting or diving effect caused by changing the relative angle of the blade with respect to the snow mass as thrust is applied. This effect is similar to that of a wing moving through air.

The angle of the push tube to the cutter blade can be set to any angle from a minimum of 0 to a maximum of 45 degrees. In general, the bend in the thrust tube is to be within 4 feet of the cutter assembly when used in the push mode with the angle of the push tube at 45 degrees. In the pull mode, the angle of the push tube can be set from 0, when used from the peak of a highly pitched surface, to 30 degrees when used on relatively flat surfaces.

BRIEF DESCRIPTION OF THE DRAWINGS

FIG. 9C is a front view of the cutting plate in a concave flexed position.

FIG. 9D is a front view of the cutting plate in a convex flexed position.

FIG. 9E is a top view of a toggle plate having a convex-curved back.

FIG. 9F is a top view of a toggle plate having a concave-curved back.

DETAILED DESCRIPTION OF THE PREFERRED EMBODIMENT

Figure 1:
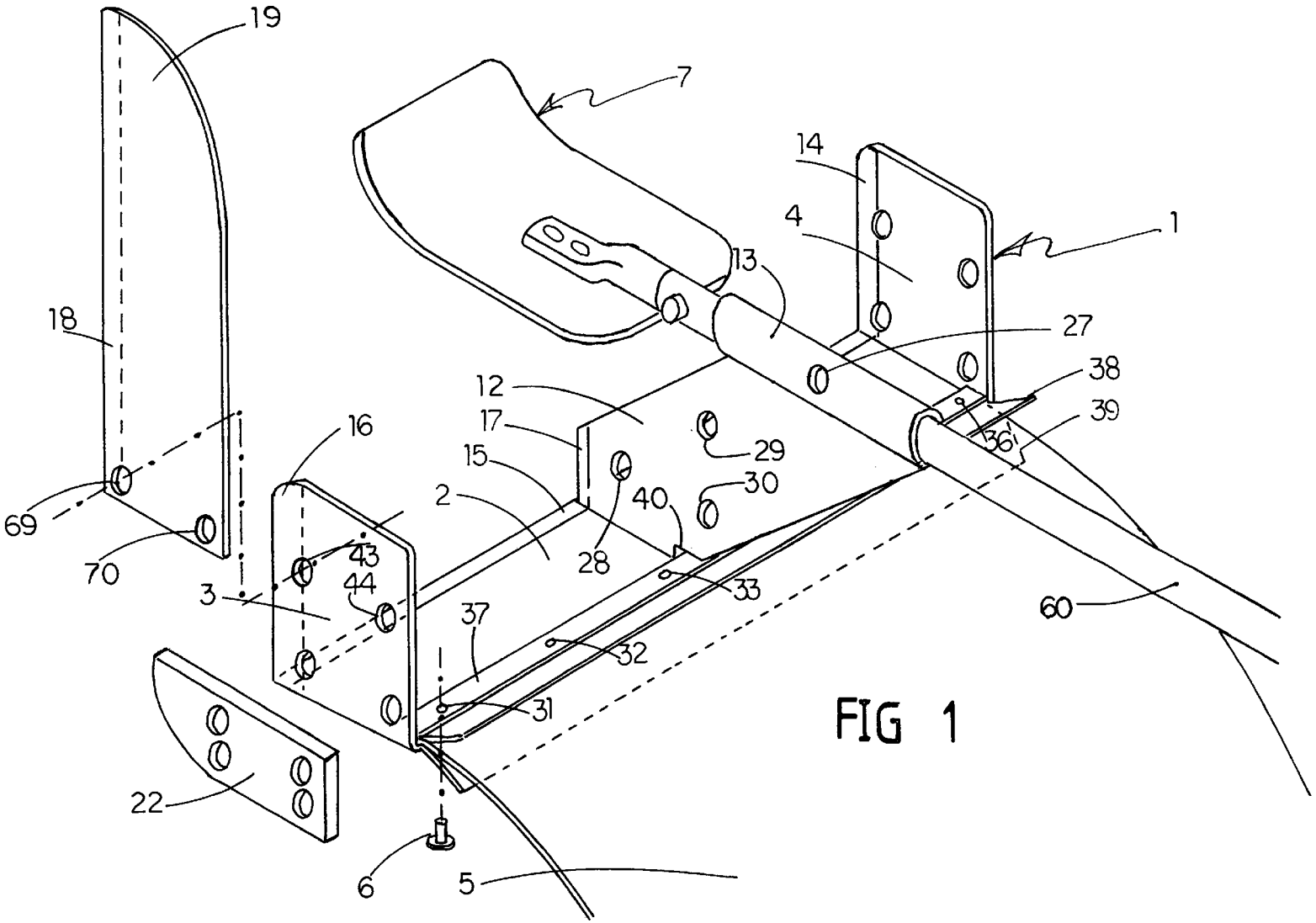
FIG. 1 is a partially-exploded perspective view showing the primary components of the described invention, including the cutter assembly, the plastic tailpiece, adjustable runners, starting aid and depth setter, and vertical cutter extensions.
Figure 2A:
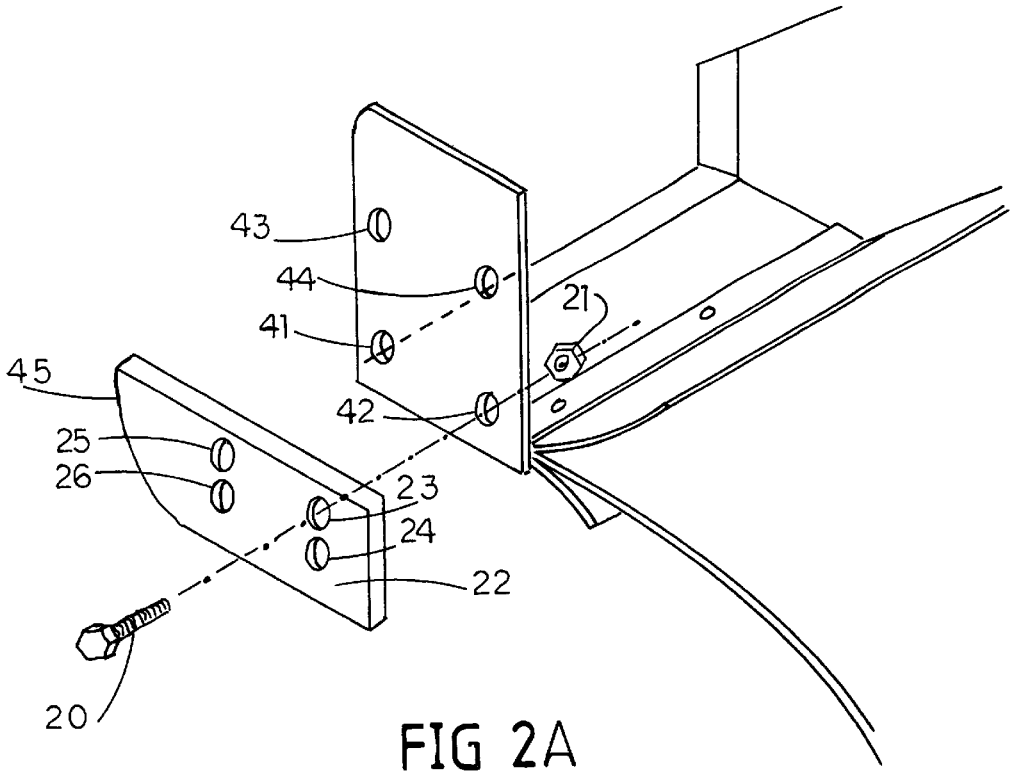
FIG. 2A is a partially-exploded perspective detail view of one of the adjustable side runners.

Referring now to FIG. 1, the basic assembly 1 has a primary cutter bar 2, a left vertical cutter wing 3, a right vertical cutter wing 4, a stiff plastic tailpiece 5, a center support 12, and a tubular coupler 13. The primary cutter bar is made from a single piece of 6061-aluminum stock, ⅛ thick and 3 inches wide by 22 inches long. The blank is drilled for all holes, as discussed below and sharpened prior to bending to form the vertical cutting wings 3 and 4. Heat treating the area 4 inches from each end to 650 degrees F or greater removes the temper and allows the bar to be bent in a very sharp right angle without failure at the bend radius. This bend can be done in a brake or a v block press, or similar means know in the art. In the preferred embodiment, the main cutting bar 2 is 14 inches wide and the vertical cutter wings 3 and 4 are 4 inches high. All forward facing edges 14,15,16 and 17 have a machined cutting bevel. These edges are sharpened to a cutting angle by passing them through a milling bit that is set to a 15 degree bevel. FIG. 1 also shows an extension 19, that is attached to the vertical cutter wings 3 and 4. FIG. 1 shows the extension 19 in position to be attached to the left wing 3 in a vertical fashion allowing for a much greater depth of snow cut. The attachable vertical cutter extensions 19 are fabricated from ⅛×3 aluminum stock 10 inches in length and sharpened in a similar manner. Holes 69 and 70 are drilled on 2 inch center to center spacing to match the corresponding holes 43 and 44 in the vertical cutters 3 and 4, and holes 28 and 30 in the center support 12. For clarity only the left side is shown. The cutter extensions are then attached with ¼×20 stainless steel machine screws 20 and NYLOCK nuts 21 as shown in FIG. 2A. In the preferred embodiment, the adjustable runners 22, are fabricated from ¼×2×4 ½ inch ultra high molecular weight polyethylene (UHMW) stock. The depth of the runner 22 is 2 inches. As shown in FIG. 2A, four holes 23, 24, 25 and 26 are drilled as shown, to adjust the clearance of the cutting edge from the subject surface.

As shown in FIGS. 1 and 9 A and B, the center support 12 is 3/16 aluminum plate, 3 inches wide and cut from a pattern and welded to the cutter blade 2. The tubular coupler 13 is 1-inch schedule 40 aluminum pipe also welded to the center support. This tubular section has a hole 27 drilled through in the center to accept a ¼-inch diameter locking pin or internal spring pin in the driver shaft. The front edge of the support 12 has a machined cutting edge 17, which provides a high strength cutting action to supplement that of the vertical cutters 3 and 4. The center support 12 also has holes 28, 29 and 30 drilled on 2 inch centers to allow for cutter bar extension 19 to be attached by bolting in either a vertical or forward facing configuration.

FIG. 1 also shows a handle 60. The handle is shown attached to the tubular coupler 13. Details of the handle are discussed below and shown in FIGS. 12A–12F.

The tailpiece 5 is 30 mil, high-density polyethylene (HDPE), 13½ inches wide and 4 ft long. It is secured to the backside of the cutter blade 2 by a series of pop-rivets 6 placed through holes 31, 32, 33, 34, 35 and 36 as shown. As part of the installation, the HDPE sheet is installed between the cutter blade 2 and an upper compression plate 37. As shown in FIGS. 1 and 2A, two additional sections of HDPE 1 inch wide by 13½ inches long 38 and 39, surround the tailpiece 5. The compression plate 37 is fabricated from aluminum stock of a nominal thickness of 0.08 inches. The plate is ½ inch wide and 13-½ inches long. The two additional sections of 30 mil HDPE 38 and 39 extending from the cutter back edge allow a softening effect for the main tailpiece when it is bent back over the cutter. This greatly extends the life of the tailpiece.

As shown in FIG. 1, the vertical support bar 12 has a notch 40 to provide clearance for the four components 37,38, 5 and 39. As discussed above, these four components are secured by inserting pop rivets 6 through the pre-drilled holes 31–36 in six places along the back edge of the cutter bar 2.

Figure 2B:
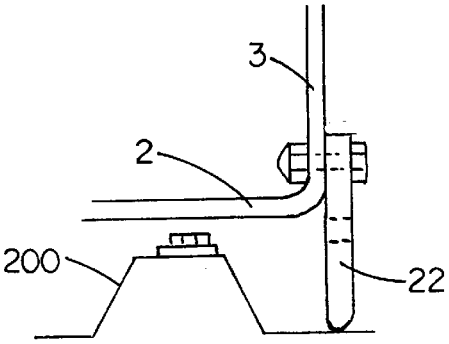
FIG. 2B is a rear detail view of one side runner showing a high cutting profile.
Figure 2C:
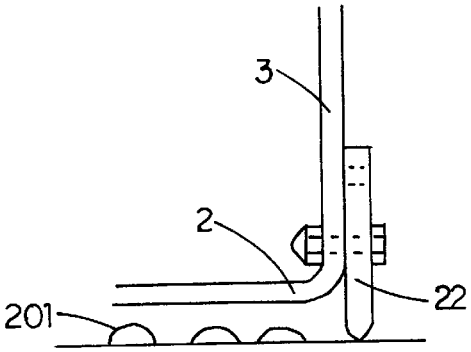
FIG. 2C is a rear detail view of one side runner showing a low cutting profile.

Referring to FIG. 2A, the adjustable side runners 22 have four holes 23, 24, 25 and 26, on 2 inch center spacing to match holes 41 and 42. The holes 23 and 24 are set at ½ inch on center spacing. The runners 22 are attached to the vertical cutter wings with ¼-20 stainless steel machine screws placed through holes as shown. As shown, bolt 20 passes through holes 23 and 42 and is secured with nut 21. The runner 22 is 4½ inches long and set flush with the back edge of the cutter. The front 1-½ inches of the projection are rounded on the bottom 45, to assist in gliding over sharp edges. The projection of the runner in front of the cutting edge keeps the edge from contacting the surface, regardless of the angle of approach of the cutter assembly to the surface. The cutter assembly can be operated with the runners set high to clear metal roofing 200, see, e.g., FIG. 2B; low, as shown in FIG. 2C to clear rivets 201; or removed completely to allow the sharpened cutting edge 15 to scrape against the surface.

Figure 3:
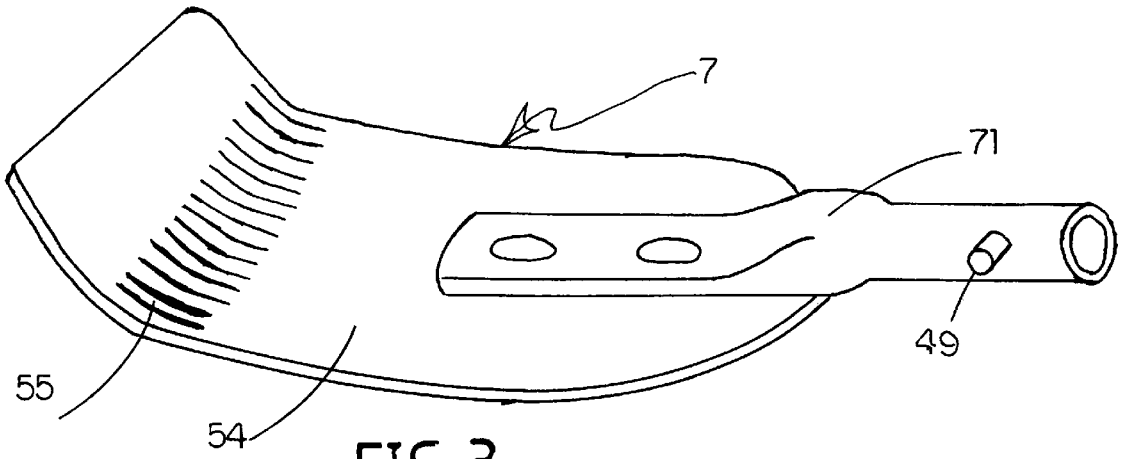
FIG. 3 is a detail view of the duck bill deep snow starting aid and depth setter.
Figure 5:
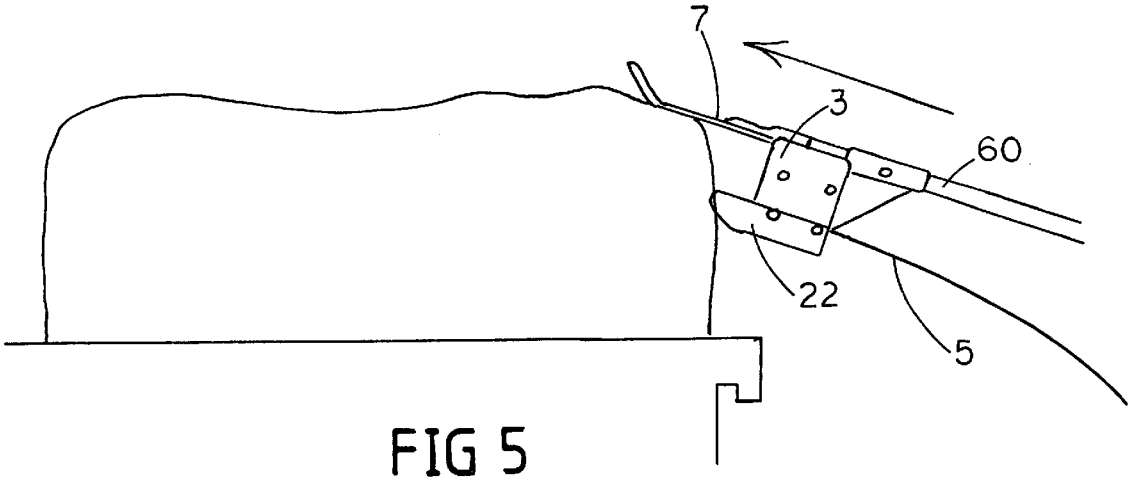
FIG. 5 is a detail view showing the relationship of the deep snow starting aid in relationship to the cutter bar prior to moving into the snow mass.

FIG. 3 shows the duck bill starting aid 7 and depth setter assembly. The duck bill 7 has a main body 54 that is fabricated from a sheet of aluminum 4 inches wide and 10 inches long. The first 3 inches of the front of the main body 54 are bent upward to form a ski tip type edge. An attachment coupler 71 is fabricated from a 4 inch long length of tubing. The tubing has an attachment means fitted into the tubing, such as a spring clip 49 or other means of attachment to the driver handle 60, as discussed below. As seen in FIG. 5, the duck bill 7 rests on the deep snow, allowing the main cutter to be supported a fixed distance down from the surface of the snow mass. As the cutter is moved forward, it enters at a depth allowing for ease of control and enhanced safety. On the return, the cutter 2 is allowed to come free of the snow, allowing the duck bill 7 to drop to the new surface and start the action again.

Figure 4:
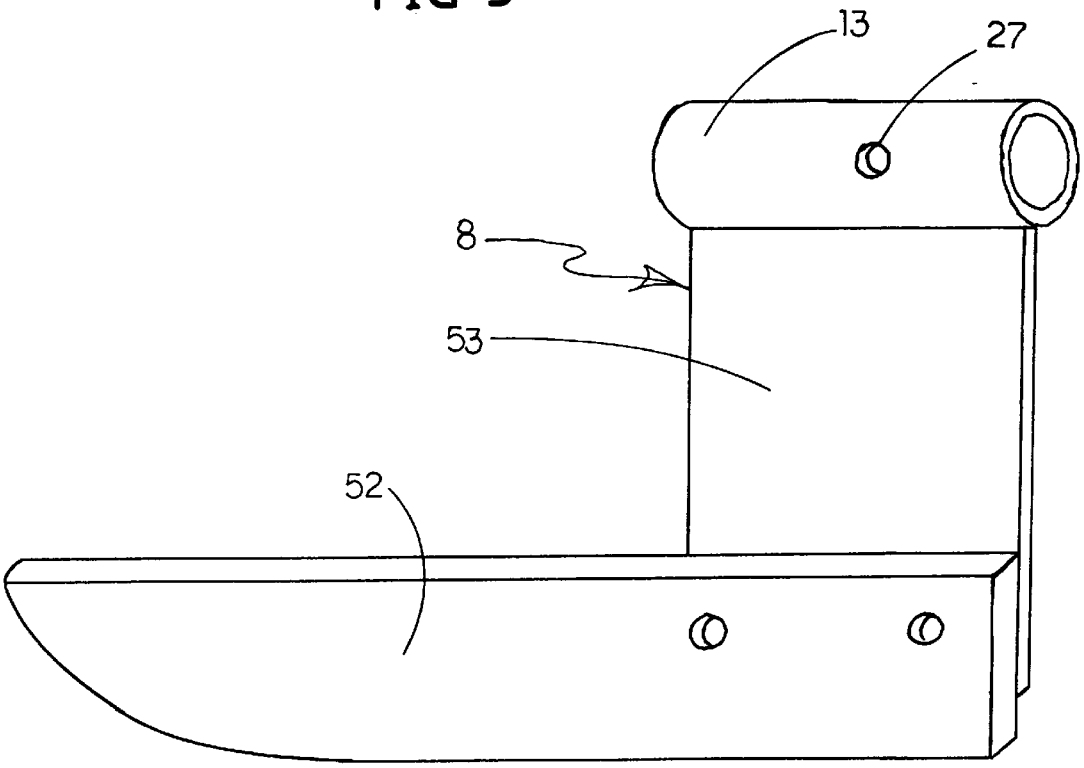
FIG. 4 is a detail view drawing of the eave edge stopper attachment.
Figure 7A:
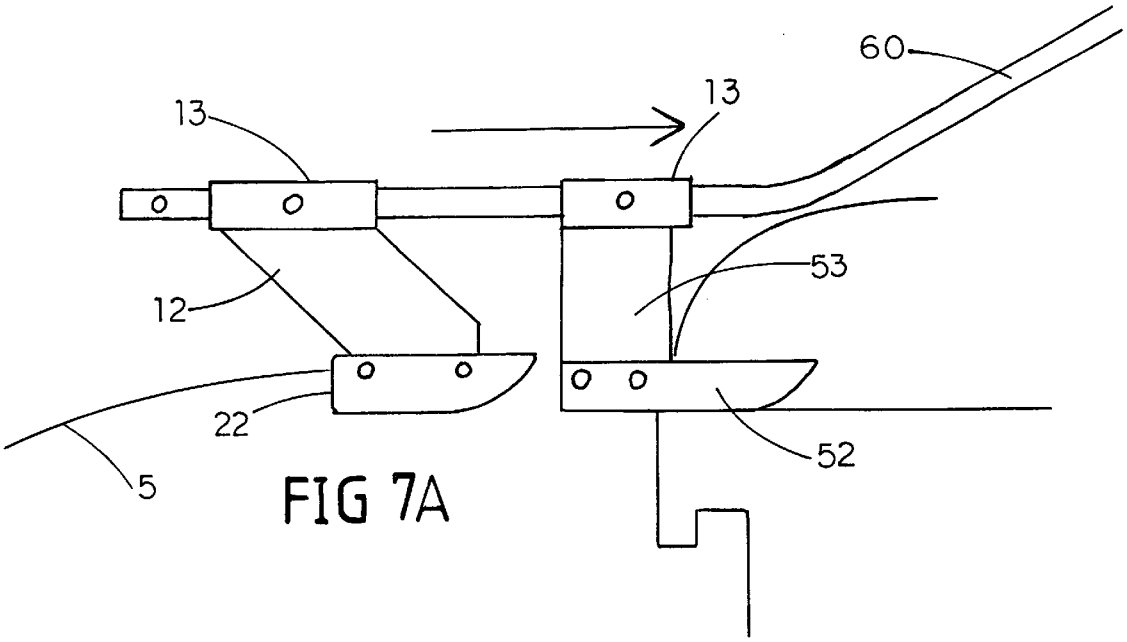
FIG. 7A is a detail view showing the eave starting aid applied to the cutter bar in a pull mode.
Figure 7B:
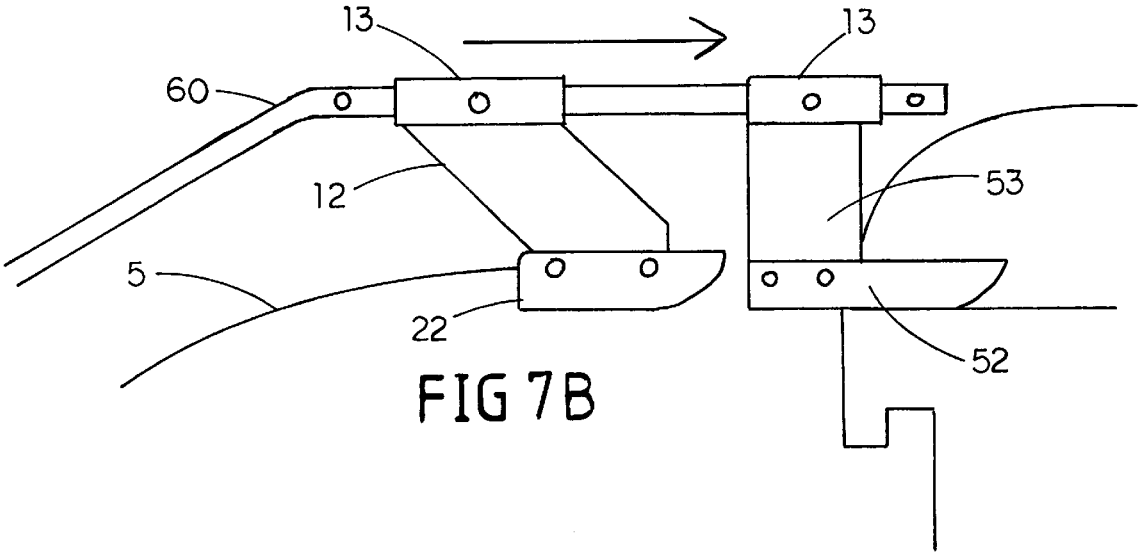
FIG. 7B is a detail view showing the eave starting aid applied to the cutter bar in a push mode.

FIG. 4 shows the quick-attach eave starting aid assembly 8. The assembly is fabricated by welding a length of aluminum bar stock 53, ⅛×3×5 inches to the tubular coupler 13. The shoe 52 of the starter 8 is fabricated from ¼ by 1½ by 8 inches long UHMW stock. It is attached to the support bar 53. The eave starter 8 is secured to the drive handle 60, as discussed below. FIGS. 7A and 7B demonstrate how the shoe 52 cuts through the snow mass to rest on the eave of the structure being cleared while the cutter bar is back out of the snow mass. The main cutter is then moved forward and the side runners naturally glide on past the roof edge and through the snow mass.

FIG. 5 shows the use of the duck bill starting aid in use and its relative position to the main cutter assembly in deep snow.

Figure 6:
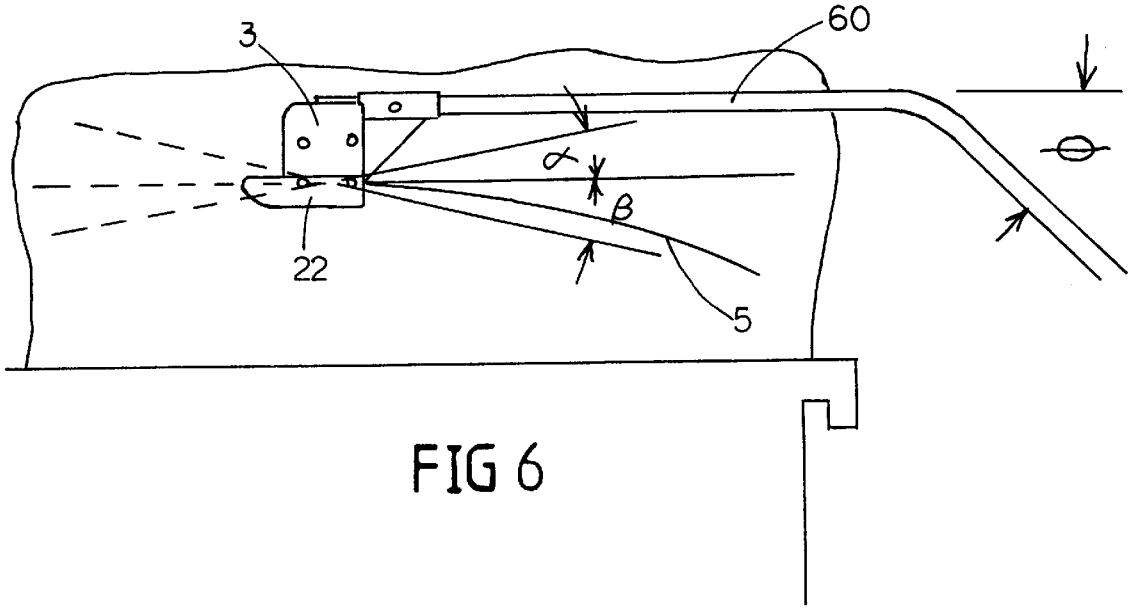
FIG. 6is a detail view of the device showing the angles of movement through the snow and the bend in the push-pull handle.

FIG. 6 demonstrates the ability of the operator to manually control the depth of cut by raising or lowering the handle 60. The wide shape of the main cutter bar allows it to move through the snow like an aircraft wing. Increasing angle of attack $\beta$ causes the main cutter to rise, reducing the depth of cut. Increasing angle $\alpha$ causes the cutter to descend, increasing the depth of cut. Angle $\theta$ is incorporated into one embodiment of the push tube handle 60 and is usually 30 to 45 degrees, depending on the angle of the surface and the distance the operator is from the edge of the structure.

As discussed above, FIGS. 7A and 7B show how the center mounted eave starting aid is applied to the main cutter assembly. FIG. 7A is in the pull mode while 7B is the push mode.

Figure 8A:
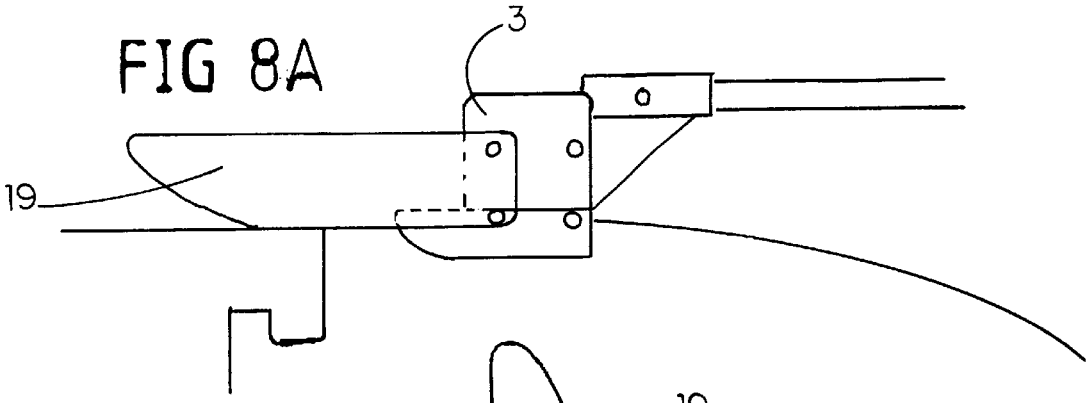
FIG. 8A is a detail view of the vertical cutter extension in the forward position.
Figure 8B:
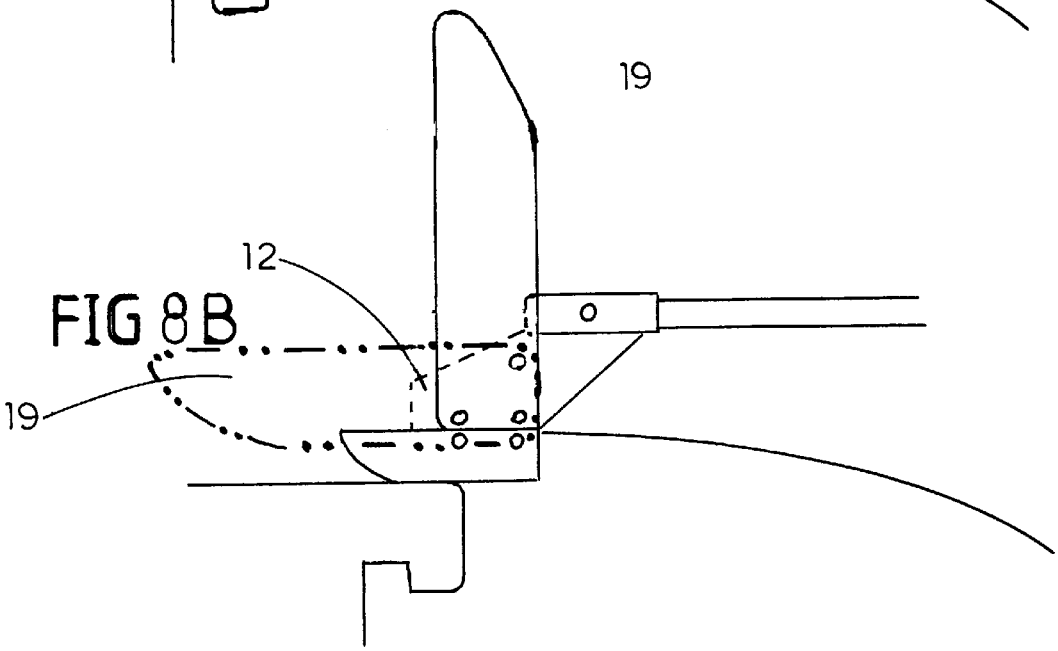
FIG. 8B is a detail view of the vertical cutter extension in the vertical position.

FIGS. 8A to 8B show how the cutter wing extensions 19 can be adapted to special snow situations. FIG. 8A shows the extension 19 bolted to the side wing 3 with the curved side facing downward. In normal use, a cutter 19 is also attached to wing 4 as well. This allows the cutter to be held back from the eave prior to forward motion in a manner similar to the eave starter attachment shown in FIGS. 4, 7A and 71B. FIG. 8B shows a cutter extension 19 bolted to the center support 12 in a vertical or forward facing mode. The vertical mode is shown with extension 19 secured with bolts as shown. The addition of this center extension 19 cuts the snow mass in half along its length as the cutter is pushed forward. As the mass is brought back to the edge, this cut allows the mass to fall on both sides of the push tube, which greatly reduces the tendency to overload the operator with the downward force of the falling snow. FIG. 8B also shows cutter extension 19 (in dashed lines) in an alternate forward facing direction. As before, cutter 19 is secured to support 12 by bolts, through the appropriate mounting holes in the center support. This mode allows the cutter extension to act as an eave starting aid in a fashion similar to FIG. 8A. The duck bill depth setter 7 can be used simultaneously with these configurations as well.

Figure 8C:
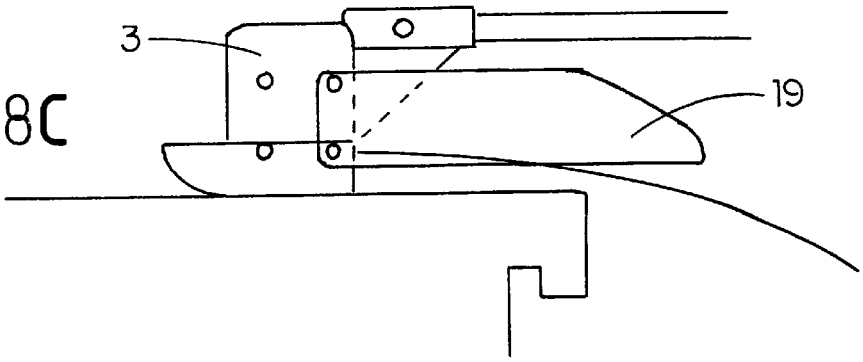
FIG. 8C is a detail view of the vertical cutter extension in the rearward position.

FIG. 8C shows the extensions 19 bolted to wings 3 and 4 in a trailing mode. Here, the extensions 19 act as a retainer to hold an amount of snow on the tailpiece as it is brought back to the edge of the surface. As discussed below, the cutter wing extensions attached as shown in FIG. 8C can be used in conjunction with the toggle plate 11, which allows a significant amount of dry loose snow to be moved across a very flat surface.

Figure 9A:
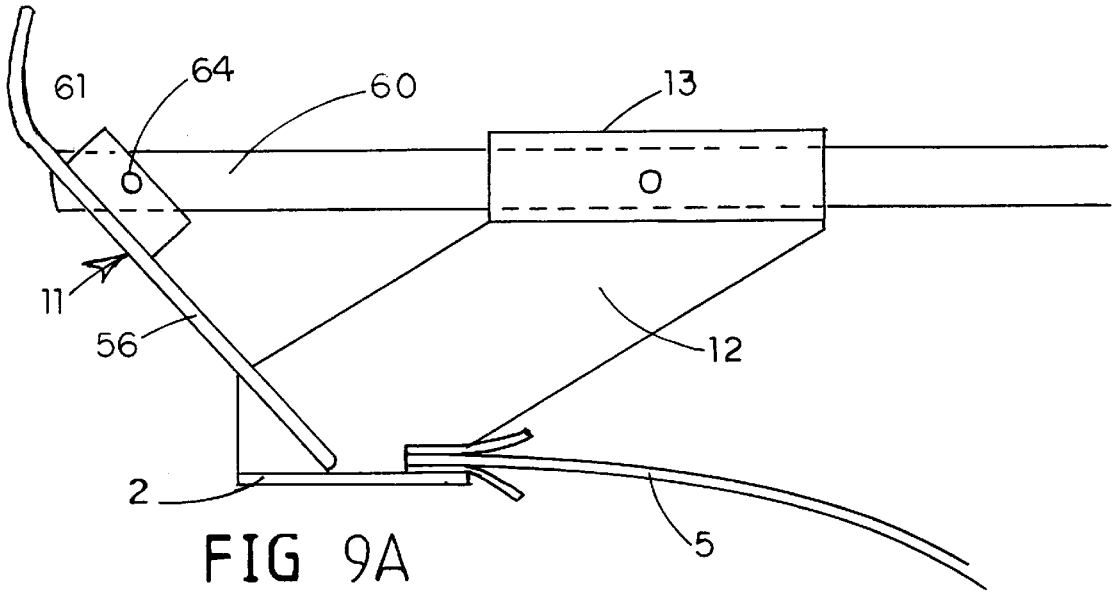
FIG. 9A is a side detail of an optional toggle plate, installed in the handle of the device.
Figure 9B:
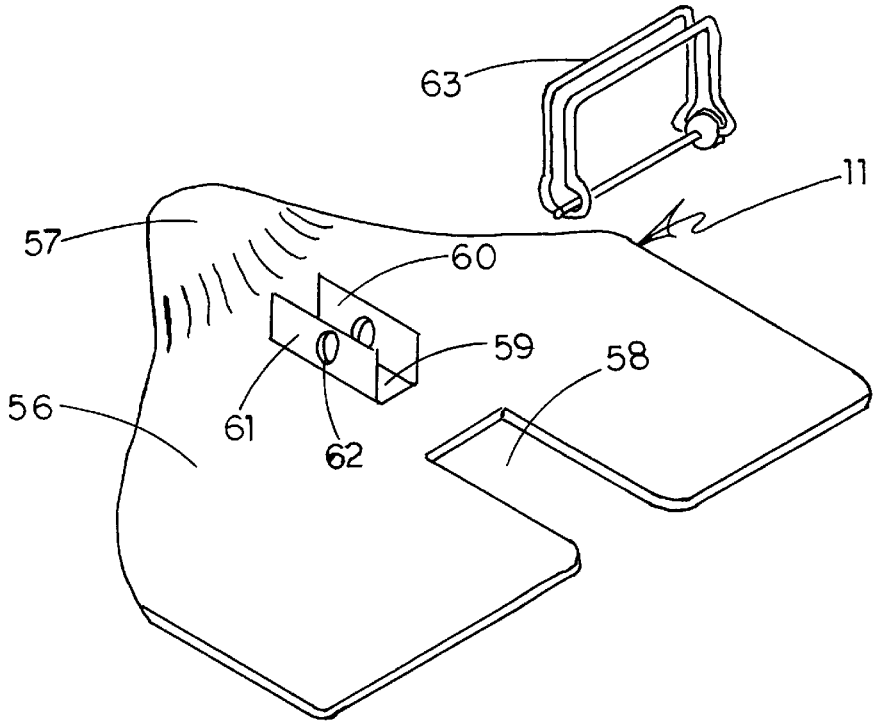
FIG. 9B is a perspective view of the optional toggle plate.

FIGS. 9A–9F detail the toggle plate assembly 11 used for special snow conditions. The plate assembly 11 is fabricated from a sheet of thin aluminum plate 56, 13½ inches wide and 12 inches long and 0.08 inches thick. The forward end of the pointed area 57 is bent upward in the form of a ski tip. At the center of the rear edge, a notch 58, 1 inch wide and 4 inches deep is cut as shown in FIG. 9B. A rectangular opening 59, 1-⅛ inch wide and 4 inches long is cut with its center 7-½ inches from the mid point of the back edge. Vertical plates 60 and 61 are fabricated from aluminum stock 1-¼×3 inches and are welded to both sides of the opening 59. A hole 62 is drilled in these vertical plates to accept a ¼ inch diameter spring bail pin 63 as shown in FIG. 9B. This pin allows the entire plate to pivot about an axis perpendicular to the push tube at location 64 as shown in FIG. 9A. The plate 11 is placed over the end of the push tube and secured in place with bail pin 63 through hole 51 in the drive handle 60 at a distance of 1 inches. This location is designated as L1 in FIG. 12F. The notch 58 allows for the plate to swing down past the front of the center blade 12 and contact the cutter bar 2 at a distance of 1 inch back from the front edge. See FIG. 9A. This toggle action cuts the snow section perpendicular to the forward motion and then acts as a push plate to assist in moving the material back. The contact with the cutter bar 2 provides for very high strength with only one pivot point. The upturned forward end of the toggle plate allows for the plate to ride over the snow like a ski and act as a depth setter and starter similar to the duck bill 7 shown in FIG. 5. This toggle plate 11 is primarily used for very flat surfaces or very loose snow pack. As in the embodiment of FIG. 8C, cutter extensions 19 can be bolted to the vertical cutter wings 3 and 4 in a trailing fashion when the toggle plate 11 is being used. As before, the extensions 19 form a retainer system that holds the loose snow in place while the assembly is moved up an inclined surface.

FIGS. 9C and 9D show how the design of the cutter bar allows it to be bent to conform to curved surfaces. This method of construction, i.e. having the thrust directed through an elevated point above the center of the attachment point between the main cutter bar 2 and the center support 12, allows the main cutter bar to be bent into curved section, either concave or convex, about the axis of the thrust tube. This allows the cutter to be used in special applications such as cleaning round tanks, telescope observatory dooms or the inside of reflector antennas such as satellite dishes. The toggle plate 11 is easily adapted to these special applications. FIGS. 9E and 9F show how the toggle plate 11 can be modified by curving the base 11*a* of the plate as shown. These curves allow the toggle plate 11 to fit along the curved main cutter bar to maintain the high strength configuration described above.

Figures 10A, 10B, 10C:
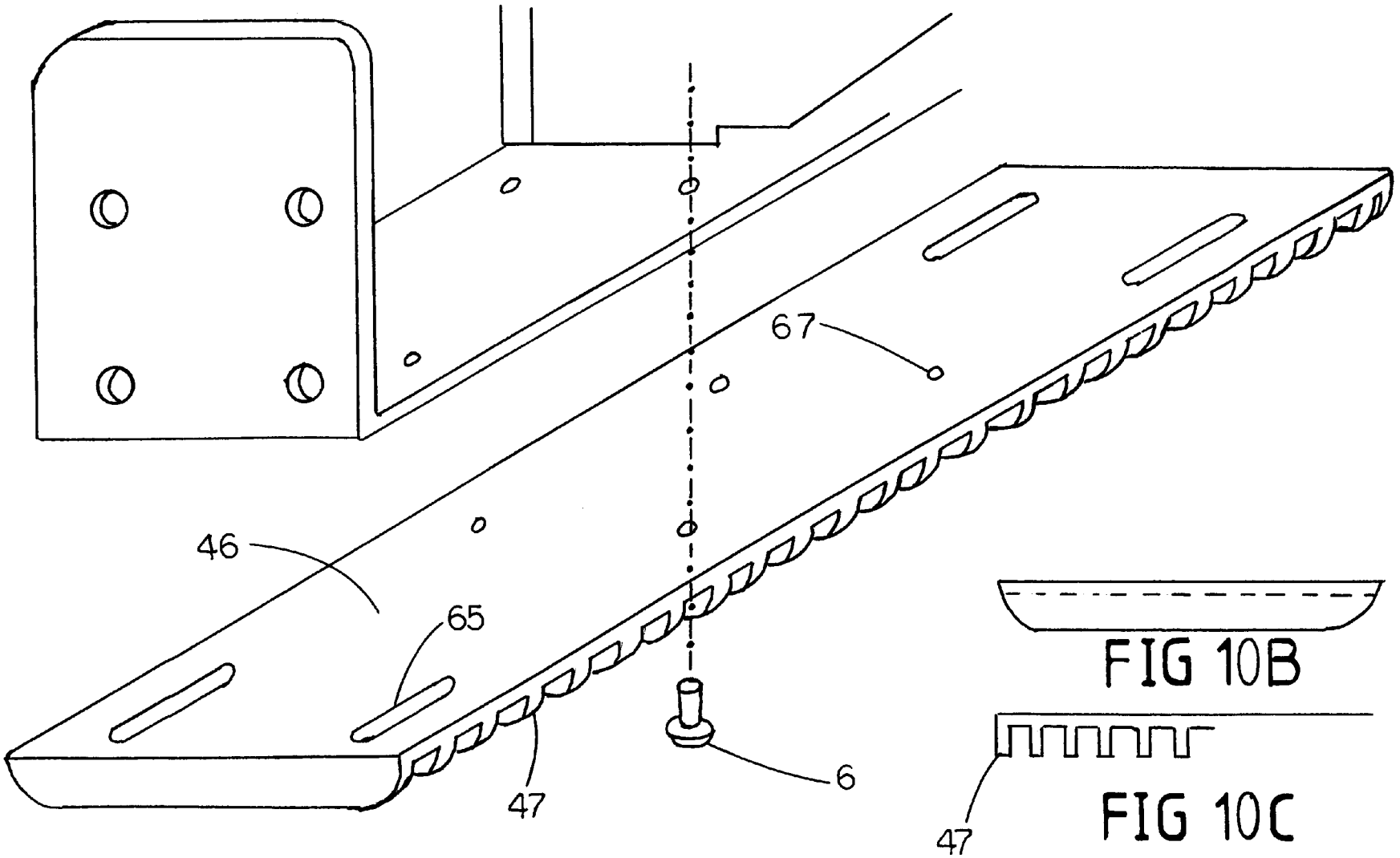
FIG. 10A is a perspective view of the cutting plate bottom protector.
FIG. 10B is a detail end view of the bottom protector.
FIG. 10C is a detail view of the bottom plate scarifier ribs.

FIGS. 10A to 10C shows the details of the bottom protector 46 and snow scarifier ridges 47. Installation of the plastic bottom plate 46, allows for almost complete removal of snow from any surface. The action of the bottom ribs 47 allows the cutter bar to ride over curved surfaces without the aluminum coming in contact with that surface which often produces a visual mar or streak of aluminum material. The ribs also break up the remaining surface layer of snow allowing for easy removal by attaching a horizontal broom attachment 9 to a driver handle. See FIG. 11A . This is especially important for surfaces such as aircraft wings requiring total removal of all snow accumulation.

In the current embodiment, the plate 46 is fabricated from a sheet of UHMW ½ inches thick by 3 inches wide and 14 inches long. The bottom edges are first milled with a ½ inch rounding over bit as shown in FIG. 10B. The bottom surface is ribbed at ½-inch spacing on center, by milling a notch ⅜ by ⅜-inch parallel to the operating axis of the cutter assembly. See FIG. 10C. The plate 46 is secured with rivets 6 through center holes 67. Rivet holes placed at 65 are elongated to compensate for the curvature of the main cutter bar when used in special applications as shown in FIGS. 9C and 9D.

Figures 11A, 11B:
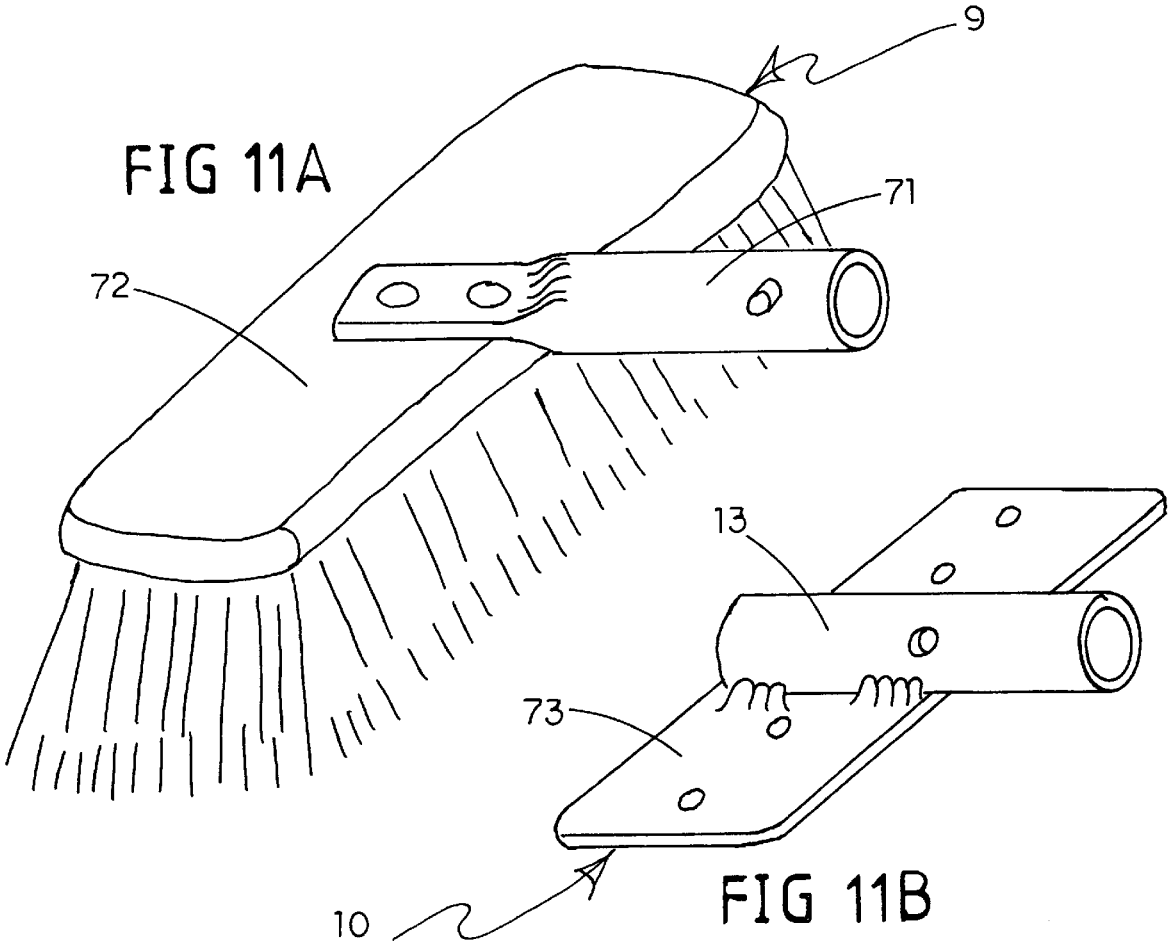
FIG. 11A is a perspective view of the optional broom attachment.
FIG. 11B is a perspective view of an optional universal adapter plate.

FIG. 11A shows the shallow angle broom attachment assembly 9. The broom attachment assembly 9 has an attachment coupler tube 71 secured to a broom head 72 by screws or other attachment means. The broom attachment 9 allows the operator to use the standard handle extensions (discussed below) to finish final cleaning of the surface. This is especially useful on surfaces such as aircraft wings.

FIG. 11B shows a universal adapter plate assembly 10. This assembly is fabricated by welding a tubular coupler 13 to a sheet of aluminum 2 inches wide by 8 inches long by ⅛ inches thick. Multiple holes are drilled in plate 73 to allow attachment to a wide broom head, rubber squeegee or other device required by special situations.

FIGS. 12A to 12F show a number of driver handle embodiments.

Figure 12A:
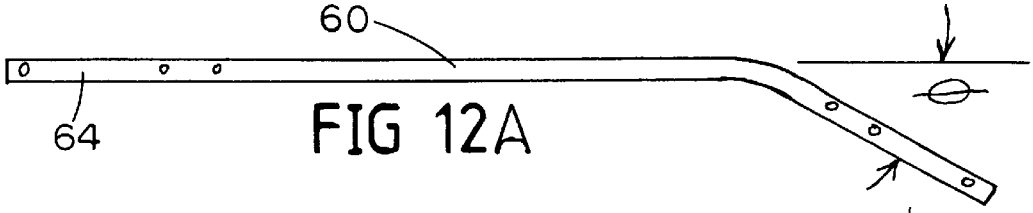
FIG. 12A is a side view of a handle having a low angle bend at one end.
Figure 12B:
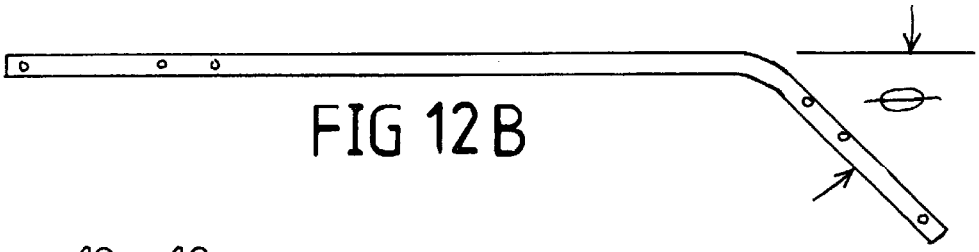
FIG. 12B is a side view of a handle having a high angle bend at one end.
Figure 12C:
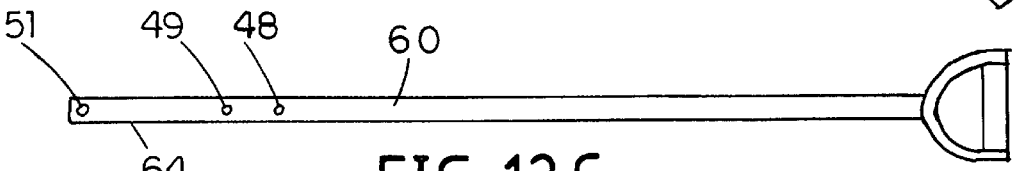
FIG. 12C is a top view of a handle with a D-grip.
Figure 12D:
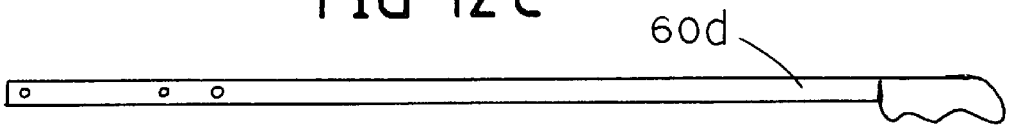
FIG. 12D is a side view of a handle with a hand grip.

The main driver handle 60, shown in FIG. 12C is formed from 1 inch outside diameter aluminum pipe six feet long with a D handle to allow for secure grip, especially when using the device in the pulling mode. The diameter of the tubing allows an easy clearance fit into the tubular attachment 13. This handle form is the preferred handle for most applications. The handle 60*d* shown in FIG. 12D has a simple grip and is used in a similar manner except it is lighter and considered to be for less severe duty applications.

The drive handle 60 may be bent as shown in FIGS. 12A and 12B. In FIG. 12A the handle is bent to form angle θ of 30 degrees. FIG. 12B shows a handle 60 set to an angle θ of 45 degrees. The handle shown in FIG. 12A is best suited for use on shallow pitched surfaces or in snow conditions requiring more directed thrust, while the handle shown in FIG. 12B is more suited for elevated flat surfaces such as motor homes and the like.

Figure 12E:
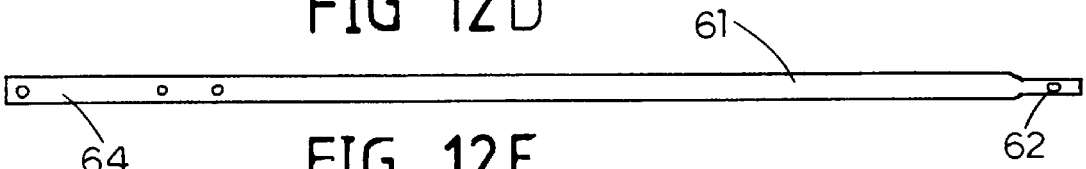
FIG. 12E is a side view of a handle extension for lengthening the reach of the handle.

FIG. 12E shows an extension 61. The extension 61 is similar to a drive handle 61 except that it has a head 62 that connects to either a drive handle 60 or to other extensions as desired. In this way, any number of extensions may be added to the drive handle 60.

Figure 12F:
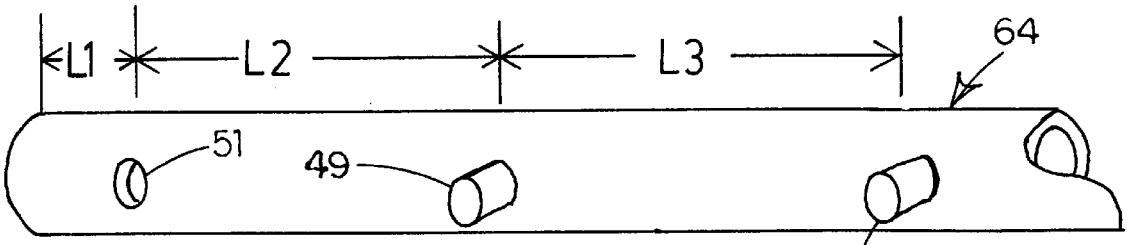
FIG. 12F is a detail of the front end of a handle showing various attachment points thereon.

Both then drive handle 60 and the extensions 61 have an attachment end 64. FIG. 12F shows the arrangement of the holes and pins at the attachment end 64 of both the handle 60 and the extensions 61. A ¼-inch diameter hole 51 is drilled ¾ inches from the end of the tube at location L1. Additional ¼-inch diameter holes are drilled at L2 at a distance of 3 inches, and at L3, a distance of 9 inches from the end of the tube. All holes 51 are fitted with internal spring pins 49 (double pins with steel inserts for high strength). Steel pins with snap over bails can also be used in these locations.

Figure 13:
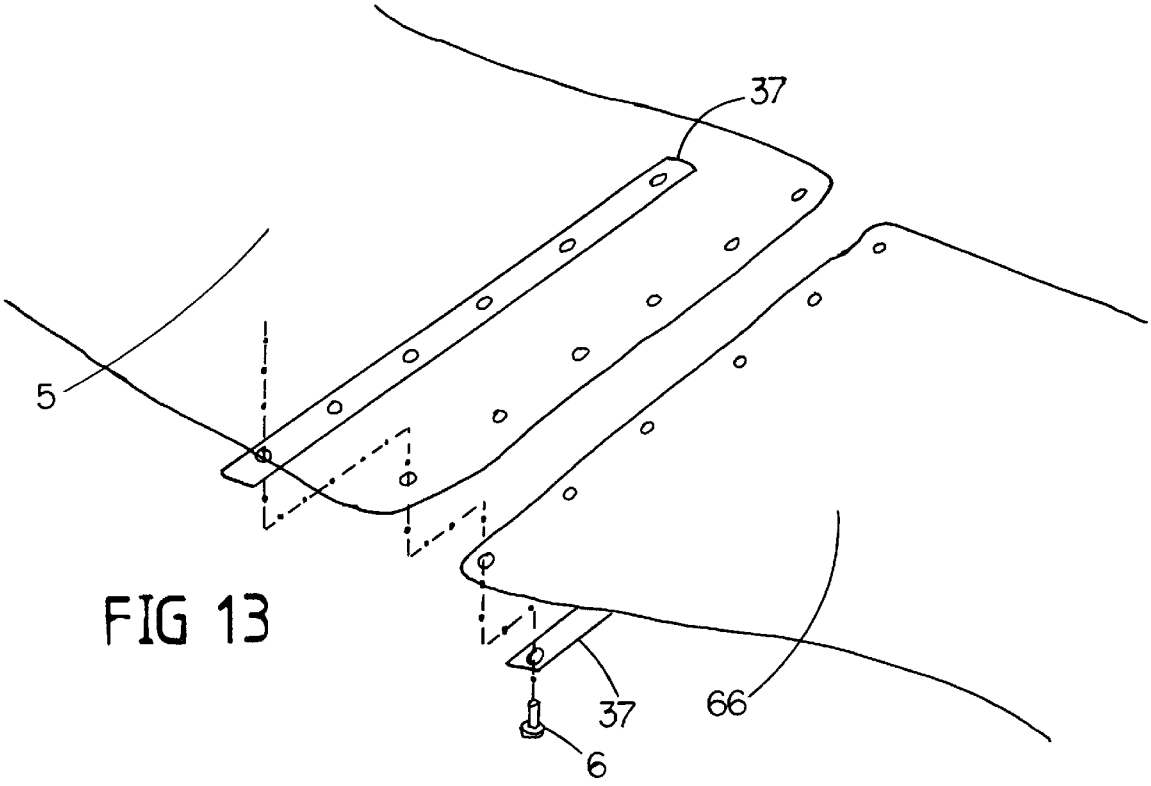
FIG. 13 is detail view showing the method of attachment of an additional plastic tailpiece to extend the tailpiece to any length.

FIG. 13 demonstrates how the basic 4 foot long tailpiece 5, can be extended to an indefinite length by adding 4 or 8 foot long sections 66 in any number. The extension 66 is secured by using pressure plate 37 in an upper and lower position with the two sections of HDPE 5 and 66 sandwiched between and secured with rivets 6 in 6 places.

Figure 14:
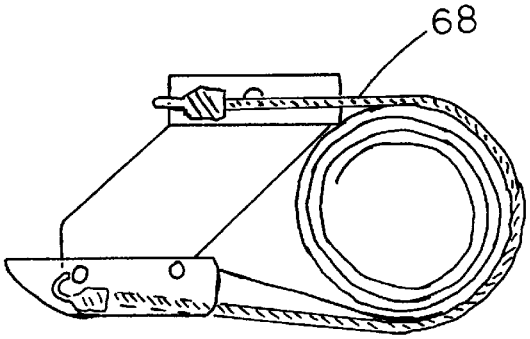
FIG. 14 is a detail view of the tailpiece rolled up and secured with an elastic cord.

FIG. 14 demonstrates the simple procedure of rolling the tailpiece toward the main cutter bar and securing it with a simple elastic cord 68. The inherent stiffness of the 30 mill HDPE allows this to be a sturdy and convenient method of storage.

Figure 15:
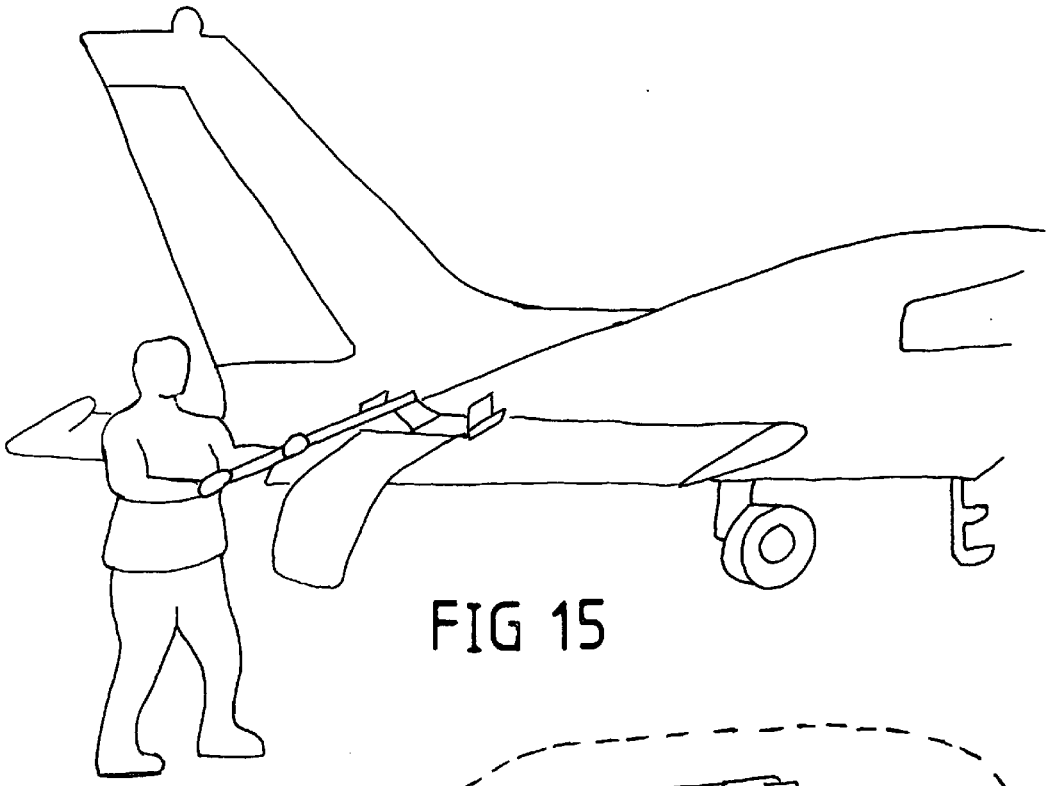
FIG. 15 shows the device cleaning the control surfaces of an airplane.
Figure 16:
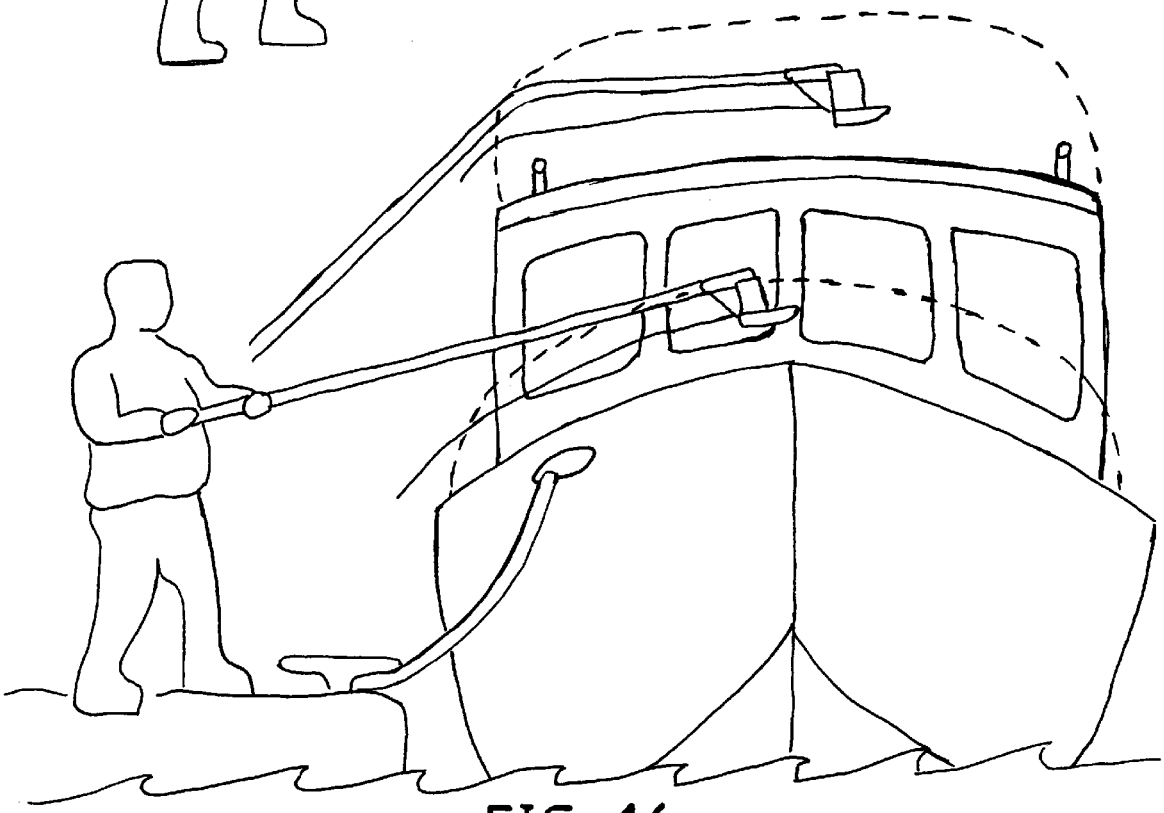
FIG. 16 shows the device cleaning a boat, using two different handle styles.
Figure 17:
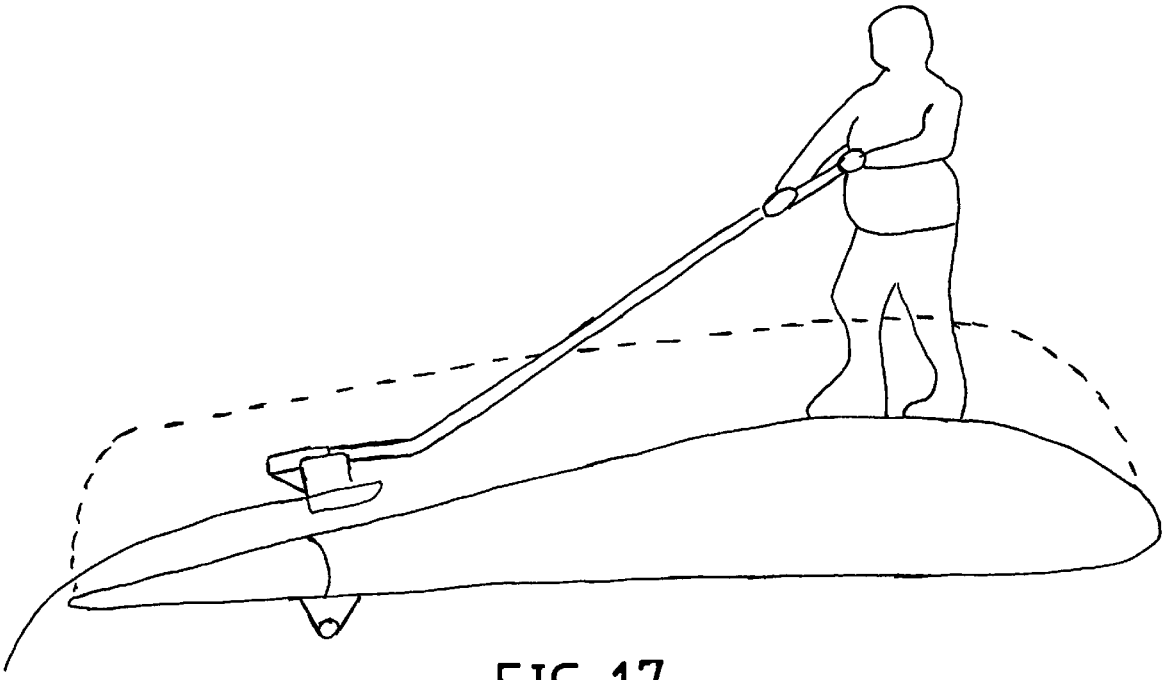
FIG. 17 shows the device in yet another configuration for cleaning an airplane wing.

FIGS. 15, 16 and 17 show the device used in typical applications. FIG. 15 shows the device cleaning the control surfaces of an airplane. FIG. 16 shows the device cleaning a boat. Here, the two different handle angles (those of FIGS. 12A and 12B) are illustrated showing the benefits and applications of both designs. FIG. 17 shows the device in yet another configuration for cleaning an airplane wing.

Although the device has been described in its preferred embodiment, it can be made of other materials and dimensions. For example, the cutter may be made of totally molded of high strength plastic with a cutter bar approx. 10 inches wide and a tailpiece approx. 24 inches long. It incorporates an integral handle of approx. 24-inch length. The primary purpose of this size is for the removal of snow from the hoods and roofs of automobiles. The tailpiece is pre-stressed to cause it to roll back toward the cutter bar in its relaxed position. There are no moving or replaceable parts.

A heavy-duty application using a cutter assembly up to 4 feet wide and with vertical cutters up to 24 inches is used for large industrial roof areas. The tailpiece is specially set to be equal to the length of the pitch and has options including power driven take up roll to pull the loaded tailpiece back to the edge of the roof. These applications are typically specially engineered to the location. The push tube assembly is power operated by electrical or hydraulic means in the push mode. A cable reel at the peak of the roof assists pull mode. In addition to the special engineering for each application, the industrial system requires special training on the part of the operator.

Finally, a heavy duty application incorporating the cutter assembly and toggle plate especially suited for chopped hard snow and the removal thereof from below equipment stuck in snow may be fabricated.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A snow removal device for elevated horizontal, pitched or curved surfaces comprising:

a) a horizontal cutter bar having a front edge, a back edge, and a pair of vertical side wings;

b) a vertical, thin, blade-like center thrust support, operably attached to said horizontal cutter bar;

c) a semi-rigid tailpiece removably attached to the back edge of said horizontal cutter bar; and d) a means for moving said horizontal cutter bar along a snow-covered surface.

2. The snow removal device of claim 1 further comprising: a pair of adjustable side runners, attached to said pair of vertical side wings.

3. The snow removal device of claim 1 further comprising a pair of cutter bar extensions, attached to said pair of vertical side wings.

4. The snow removal device of claim 3 wherein said pair of cutter bar extension extends forward from said pair vertical side wings and lie in a horizontal plane with respect to said pair of vertical side wings.

5. The snow removal device of claim 3 wherein said pair of cutter bar extension extends reward from said pair vertical side wings and lie in a horizontal plane with respect to said pair of vertical side wings.

6. The snow removal device of claim 3 wherein said pair of cutter bar extension extends upward from said pair vertical side wings and lie in a vertical plane with respect to said pair of vertical side wings.

7. The snow removal device of claim 3 further comprising a cutter bar extension, removably attached to the center thrust support of said horizontal cutter bar.

8. The snow removal device of claim 1, wherein the means for moving said horizontal cutter bar along a snow-covered surface comprise a drive handle.

9. The snow removal device of claim 8 wherein the drive handle has an angled portion formed therein.

10. The snow removal device of claim 1 further comprising a duckbill shaped aid attached to said horizontal cutter bar as a means for starting and depth control in deep snow.

11. The snow removal device of claim 1 further comprising an eve starting aid attached to said horizontal cutter bar.

12. The snow removal device of claim 1 further comprising a toggle plate, attached to said horizontal cutter bar, such that said toggle plate is used as a means for holding loose snow in place.

13. The snow removal device of claim 12 whereas the horizontal cutter bar is curved.

14. The snow removal device of claim 13 wherein the toggle plate is adapted to fit the curve of said horizontal cutter bar.

15. The snow removal device of claim 1 further comprising a broom attachment attached to said horizontal cutter bar.

16. The snow removal device of claim 1 further comprising a universal adapter plate attached to said horizontal cutter bar.

17. The snow removal device of claim 1 further comprising at least one tailpiece extension, fixedly attached to said semi-rigid tailpiece, whereby said semi-rigid tailpiece can be lengthened by an incremental amount.

18. The snow removal device of claim 1 wherein the semi-rigid tailpiece is rolled for storage.

19. The snow removal device of claim 1 further comprising: a plastic protector, having a bottom surface, attached to said horizontal cutter bar; wherein said plastic protector having a plurality of parallel ribs formed on said bottom surface of said plastic protector, whereby said plurality of parallel ribs forms a scarifier texture.

* * * * *